United States Patent [19]

Branovich et al.

[11] Patent Number: 5,007,874

[45] Date of Patent: Apr. 16, 1991

[54] METHOD OF MAKING A CATHODE FROM TUNGSTEN AND IRIDIUM POWDERS USING A REACTION PRODUCT FROM REACTING A GROUP III A METAL WITH BARIUM PEROXIDE AS AN IMPREGNANT

[75] Inventors: Louis E. Branovich, Howell; Donald W. Eckart, Wall; Bernard Smith, Ocean; Gerard Freeman, Freehold, all of N.J.

[73] Assignee: The United States of America as represented by the Secretary of the Army, Washington, D.C.

[21] Appl. No.: 597,637

[22] Filed: Oct. 15, 1990

[51] Int. Cl.[5] ..... H01J 9/04

[52] U.S. Cl. ..... 445/50; 313/346 DC

[58] Field of Search ..... 445/50, 51; 313/346 R, 313/346 DC

[56] References Cited

U.S. PATENT DOCUMENTS

| | | | |
|---|---|---|---|
| 2,700,118 | 1/1955 | Hughes et al. | 313/346 DC |
| 2,722,626 | 11/1955 | Coppola et al. | 313/346 R |
| 4,808,137 | 2/1989 | Branovich et al. | 445/50 |
| 4,863,410 | 9/1989 | Branovich et al. | 445/50 |

*Primary Examiner*—Kenneth J. Ramsey

*Attorney, Agent, or Firm*—Michael Zelenka; Roy E. Gordon

[57] ABSTRACT

A cathode is made from a mixture of tungsten and iridium powders using a reaction product formed from reacting a Group III A metal powder with barium peroxide powder as an impregnant.

9 Claims, No Drawings

METHOD OF MAKING A CATHODE FROM TUNGSTEN AND IRIDIUM POWDERS USING A REACTION PRODUCT FROM REACTING A GROUP III A METAL WITH BARIUM PEROXIDE AS AN IMPREGNANT

GOVERNMENT INTEREST

The invention described herein may be manufactured, used, and licensed by or for the Government for governmental purposes without the payment to us of any royalty thereon.

FIELD OF INVENTION

This invention relates in general to a method of making a long life high current density cathode and in particular, to a method of making such a cathode by mixing tungsten and iridium powders to form a porous billet and using a reaction product formed from reacting a Group III A metal with barium peroxide as an impregnant for the porous billet.

BACKGROUND OF THE INVENTION $Ba_3Al_2O_6$ has long been known to be valuable as an impregnant for porous billets in the manufacture of high current density cathodes. $Ba_3Al_2O_6$ has heretofore been prepared according to the reaction:

$$3BaCO_3+Al_2O_3 \rightarrow Ba_3Al_2O_6+3CO_2$$

or to the reaction:

$$6BaO_2+2Al_2O_3 \rightarrow 2Ba_3Al_2O_6+3O_2$$

The difficulty with the aforesaid reactions is that they involve high temperatures that cause too much impregnant to be used up prior to placing the impregnant in the cathode environment. This cuts down on the life of the cathode. Moreover, the gaseous by-products in the foregoing reactions create vacant holes in the pores of the billet after the impregnant solidifies causing the impregnant to pop out of the cathode environment.

SUMMARY OF THE INVENTION

The general object of this invention is to provide an improved method of making a long life high current density cathode. A more particular object of the invention is to provide such a method that will be rapid and direct and in which the emission of the resulting cathode over a set time period will be sufficient. A still further object of the invention is to provide such a method of making a cathode in which the impregnant will be formed at lower temperatures.

It has now been found that such a method can be provided by making such a cathode from a mixture of tungsten and iridium powders to form a porous billet and using a reaction product formed from reacting a Group III A metal powder with barium peroxide powder as the impregnant for the porous billet.

The Group III A metals referred to herein are the metals of Group III A of the Periodic Table. These metals are boron, aluminum, gallium, indium, and thallium. In the case of aluminum for example, the impregnant would form according to the reaction:

$$2Al+3BaO_2 \rightarrow Ba_3Al_2O_6.$$

This reaction can be seen at 625°-700° C. in an inert atmosphere such as argon. Not only is the temperature of the reaction low, but no by-products of reaction such as $CO_2$ or $O_2$ are formed that come off before the reaction is complete.

In the case of gallium, the impregnant, $Ba_3Ga_2O_6$ is formed according to the reaction:

$$2Ga+3BaO_2 \rightarrow Ba_3Ga_2O_6.$$

In the case of indium, the impregnant, $Ba_3In_2O_6$ is formed according to the reaction:

$$2In+3BaO_2 \rightarrow Ba_3In_2O_6.$$

In the reaction, the metal powder and the $BaO_2$ powder are directly added to the porous billet and a low melting point impregnation occurs. Due to the low temperature impregnation, the method cuts down on the amount of barium metal generated during impregnation. The higher the melting point needed for impregnation, the more free barium generated and the less barium to be generated when the impregnated billet is placed into a cathode environment. This gives longer life to the cathodes made by the method of the invention.

In the reaction of the metal with the barium peroxide, the particle size of the barium peroxide powder and the metal powder should be approximately the same and under 50 microns. The smaller the particle size and the closeness of the particles to each other the greater the enhancement of the chemical reaction.

The material used for impregnation, that is, the barium peroxide powder and the metal powder such as aluminum, gallium, or indium are dessicated and then cooled in an inert atmosphere. The materials are then presieved prior to impregnation into the porous billet in order to get as small a particle size as possible with a particle size distribution of under 50 microns.

DESCRIPTION OF THE PREFERRED EMBODIMENT

A long life high current density cathode is made in the following manner. Tungsten and iridium powders are mixed in a weight ratio of about 61 weight percent tungsten to about 38 weight percent iridium. 1 weight percent of zirconium hydride activator is added to the mixture and the mixture ball milled for about 8 hours. The ball milled mixture is then pressed into a billet at about 48,000 psi in a die and the billet then sintered at 1800° C. for thirty minutes in dry hydrogen of less than −100 dewpoint. The billet is then backfilled with copper in dry hydrogen at 1500° C., the billet machined to the desired geometry, and the copper then removed by etching in nitric acid. The porous billet is then thoroughly rinsed in deionized water, methanol, and then dried. The billet is then impregnated with the reaction product obtained by reacting aluminum with barium peroxide in the mole ratio of 2:3 with heating to about 700° C. for about two minutes. After the billet is cooled, loose particles of impregnant are removed from the billet using a jeweler's lathe and fine alumina cloth.

The resulting cathode is then mounted in a test vehicle and activated using standard matrix cathode activation procedures.

We wish it to be understood that we do not desire to be limited to the exact details of construction as described for obvious modifications will occur to a person skilled in the art.

What is claimed is:

1. Method of making a cathode for operation in microwave devices from tungsten and iridium powders using a reaction product formed from reacting a Group III A metal powder with barium peroxide powder in the mole ratio of 2 to 3 as an impregnant, said method including the steps of (A) mixing the tungsten and iridium powders, (B) adding about 2 percent by weight of an activator to the mixture, (C) ball milling the mixture for about 8 hours, (D) pressing the ball milled mixture into a billet at about 48,000 psi in a die, (E) sintering the billet at about 1800° C. for about thirty minutes in dry hydrogen of less than −100 dewpoint, (F) backfilling the billet with copper in dry hydrogen at about 1500° C., (G) machining the billet to the desired geometry, (H) removing the copper by etching in nitric acid, (I) thoroughly rinsing in deionized water, methanol and then drying, (J) firing the billet in dry hydrogen at about 140° C. for about 15 minutes, (K) impregnating the billet with reaction product formed from reacting a Group III A metal powder with barium peroxide powder in the mole ratio of 2 to 3 by firing the billet in a dry hydrogen furnace at a temperature at which the impregnant melts for about two minutes.

(L) removing the billet from the furnace after the furnace is cooled, and (M) removing any loose pieces of impregnant from the billet.

2. Method of making a cathode according to claim 1 wherein in step (A), the tungsten and iridium powders are mixed in a weight ratio of about 61 weight percent tungsten to about 38 weight percent iridium.

3. Method of making a cathode according to claim 1 wherein in step (B), the activator is about 1 weight percent zirconium hydride.

4. Method of making a cathode according to claim 1 wherein in step (K), the average particle size of the barium peroxide powder is under 50 microns and close to the average particle size of the Group III A metal powder.

5. Method of making a cathode according to claim 1 wherein the Group III A metal is selected from the group consisting of aluminum, gallium, and indium.

6. Method of making a cathode according to claim 5 wherein the Group III A metal is aluminum.

7. Method of making a cathode according to claim 5 wherein the Group III A metal is gallium.

8. Method of making a cathode according to claim 5 wherein the Group III A metal is indium.

9. Method of making a cathode for operation in microwave devices from tungsten and iridium powders using a reaction product formed from reacting aluminum powder with barium peroxide powder in the mole ratio of 2 to 3 as an impregnant, said method including the steps of (A) mixing the tungsten and iridium powders in the weight ratio of about 61 weight percent tungsten to about 38 weight percent iridium, (B) adding about 1 percent by weight of zirconium hydride to the mixture, (C) ball milling the mixture for about 8 hours, (D) pressing the ball milled mixture into a billet at about 48,000 psi in a die, (E) sintering the billet at about 1800° C. for about thirty minutes in dry hydrogen of less than −100 dewpoint, (F) backfilling the billet with copper in dry hydrogen at about 1500° C., (G) machining the billet to the desired geometry, (H) removing the copper by etching in nitric acid, (I) thoroughly rinsing in deionized water, methanol and then drying, (J) firing the billet in dry hydrogen at about 1400° C. for about 15 minutes, (K) impregnating the billet with reaction product formed from reacting aluminum powder with barium peroxide powder in the mole ratio of 2 to 3 wherein the average particle size of the barium peroxide powder is under 50 microns and close to the average particle size of the aluminum powder by firing the billet in a dry hydrogen furnace at a temperature at which the impregnant melts for about two minutes, (L) removing the billet from the furnace after the furnace is cooled, and (M) removing any loose pieces of impregnant from the billet.

* * * * *